US012365428B2

(12) United States Patent
Joester et al.

(10) Patent No.: US 12,365,428 B2
(45) Date of Patent: Jul. 22, 2025

(54) SUPPORT FRAME FOR A BREATHING APPARATUS

(71) Applicant: DRAGER SAFETY AG & CO. KGaA, Lubeck (DE)

(72) Inventors: Carsten Joester, Lubeck (DE); Matthew William Locke, Morpeth (GB)

(73) Assignee: Dräger Safety AG & Co. KGaA, Lübeck (DE)

( * ) Notice: Subject to any disclaimer, the term of this patent is extended or adjusted under 35 U.S.C. 154(b) by 245 days.

(21) Appl. No.: 18/208,370

(22) Filed: Jun. 12, 2023

(65) Prior Publication Data

US 2023/0406466 A1 Dec. 21, 2023

(30) Foreign Application Priority Data

Jun. 16, 2022 (EP) ..... 22179431

(51) Int. Cl.
*B63C 11/02* (2006.01)
*B63C 11/22* (2006.01)

(52) U.S. Cl.
CPC ..... *B63C 11/02* (2013.01); *B63C 2011/026* (2013.01); *B63C 2011/2281* (2013.01)

(58) Field of Classification Search
CPC ..... B63C 11/02
USPC ..... 224/191
See application file for complete search history.

(56) References Cited

U.S. PATENT DOCUMENTS 5,913,467 A * 6/1999 Berg ..... A62B 9/04 224/628
7,367,749 B2 * 5/2008 Kim ..... A45F 3/047 405/186
8,006,877 B2 * 8/2011 Lowry ..... A45F 3/04 224/660
8,356,692 B1 * 1/2013 Steck ..... A62B 35/0025 182/4
9,220,333 B2 * 12/2015 Losos ..... A45F 3/047
(Continued)

FOREIGN PATENT DOCUMENTS

DE 3342202 A1 7/1984
EP 3871739 A1 9/2021
(Continued)

OTHER PUBLICATIONS

European Search Report, dated Nov. 30, 2022, issued in priority EP Application No. 22 17 9431.

*Primary Examiner* — Nathan J Newhouse
*Assistant Examiner* — Lester L Vanterpool
(74) *Attorney, Agent, or Firm* — Banner & Witcoff, Ltd.

(57) ABSTRACT

Disclosed is a support frame for a breathing apparatus comprising a cylinder cradle for supporting a compressed gas cylinder, a cylinder-retaining strap having a first end secured to the support frame at a first fixing point and a second end adjustably secured to the cylinder-retaining strap between the first and second ends, wherein the adjustable strap loop is secured to a second fixing point so as to form an effective strap length between the first and second fixing points, and a releasable third fixing point, wherein the effective strap length is adjustable by adjusting a position of the second end along the strap to thereby adjust a size of the adjustable strap loop, and releasably securing the adjustable strap loop to the third fixing point.

11 Claims, 4 Drawing Sheets

(56) References Cited

U.S. PATENT DOCUMENTS

| | | | | |
|---|---|---|---|---|
| 9,889,911 | B1 * | 2/2018 | Stella | B63C 11/22 |
| 10,286,233 | B2 * | 5/2019 | Wang | A62B 9/04 |
| 10,717,507 | B2 * | 7/2020 | Stella | F16B 2/005 |
| 10,850,138 | B2 * | 12/2020 | Liu | A62B 25/00 |
| 2015/0151146 | A1 * | 6/2015 | Tekelenburg | A62B 9/04 224/582 |
| 2020/0008561 | A1 * | 1/2020 | Romang | A45F 5/1575 |
| 2022/0055049 | A1 * | 2/2022 | Rankin, Sr. | B05B 9/0888 |
| 2023/0019536 | A1 * | 1/2023 | Zanella, Jr. | F17C 13/084 |

FOREIGN PATENT DOCUMENTS

| | | | |
|---|---|---|---|
| GB | 2520164 | A | 5/2015 |
| GB | 2573332 | A | 11/2019 |

* cited by examiner

SUPPORT FRAME FOR A BREATHING APPARATUS

CROSS-REFERENCE TO RELATED APPLICATIONS

This application claims priority to European Application No. EP 22179431.6, filed Jun. 16, 2022, the entire contents of which being fully incorporated herein by reference.

The present disclosure relates to a support frame for a breathing apparatus and is particularly, although not exclusively, concerned with a cylinder-retaining strap apparatus for a breathing apparatus, such as a self-contained breathing apparatus (SCBA).

BACKGROUND OF THE INVENTION

Breathing apparatuses, such as self-contained breathing apparatus (SCBAs), comprise breathing gas cylinders which are replaceable. Such cylinders must be securely retained on the breathing apparatus, so it is known to provide a strap which retains the cylinder against a frame of the breathing apparatus. However, such known straps have a small range of adjustment which only permit them to retain cylinders having a small range of different diameters. Further, even if a strap is sufficiently long to accommodate a wide range of different cylinders, the excess strap material which is present when securing cylinders at the lower end of its range can be difficult to manage, and can cause snagging hazards which are extremely dangerous to emergency services personnel using the breathing apparatus.

Accordingly, it will be appreciated that improvements in cylinder-retaining straps for breathing apparatus are desirable.

SUMMARY OF THE INVENTION

According to a first aspect, there is provided a support frame for a breathing apparatus comprising: a cylinder cradle for supporting a compressed gas cylinder on the support frame; a cylinder-retaining strap having a first end secured to the support frame at a first fixing point and a second end adjustably secured to the cylinder-retaining strap between the first and second ends so as to form an adjustable strap loop formed of a portion of the cylinder-retaining strap, wherein the adjustable strap loop is secured to a second fixing point so as to form an effective strap length between the first and second fixing points; and a releasable third fixing point; wherein the effective strap length is adjustable by: adjusting a position of the second end along the strap to thereby adjust a size of the adjustable strap loop; and releasably securing the adjustable strap loop to the third fixing point.

The second end of the strap may be secured at an adjustable intermediate point along the length of the strap. Intermediate position in this context should not be understood as implying any particular single position (such as an exact mid-point) and should instead be understood that the connection is made somewhere along the strap between the first and second ends.

For any given cylinder size or configuration, any unrequired or slack portion of the strap can be taken up un the adjustable strap loop by adjusting the position of the second end relative to the strap. Further, the slack in the adjustable strap loop can then be secured by securing the strap loop to the third fixing point. In this contracted configuration, the adjustable strap loop is therefore connected to both the second and third fixing points.

The second end of the cylinder-retaining strap may be secured to a slidable buckle on the strap.

The slidable buckle may be configured such that moving the buckle along the strap towards the first fixing point increases the size or length of the adjustable strap loop.

The strap may pass through the buckle, or through two apertures of the buckle, so as to slidably secure the buckle to the strap.

The cylinder cradle may be configured to support a cylinder extending longitudinally on the support frame. The first and second fixing points may be arranged on opposing lateral sides of the cylinder cradle. The first and second fixing points may be laterally spaced across the cylinder in use. The first and second fixing point may be pins, or releasable pins.

A support frame for a breathing apparatus as claimed in claim 3, wherein the third fixing point is arranged laterally outside the first fixing point.

The third fixing point may be arranged on the same side of the cylinder cradle to the first fixing point. The third fixing point may be arranged further from the cylinder cradle than the first fixing point. The third fixing point may be a releasable pin.

The second fixing point may be provided on the support frame, or may be provided on or with a secondary strap secured to the support frame.

The second fixing point may be provided on a tensioning buckle secured to the support frame by a secondary strap.

The adjustable strap loop may extend around a pin of the tensioning buckle, which forms the second fixing point. The tensioning buckle may be further secured to the secondary strap, and the secondary strap may be further secured to a fourth fixing point provided on the support frame.

The fourth fixing point may be provided on an opposing lateral side of the cylinder cradle to the first and third fixing points.

The tensioning buckle may comprise a cam mechanism or over-centre mechanism for tightening or tensioning the cylinder-retaining strap.

The support frame may further comprise a pull-down strap.

The pulldown strap may extend between the support frame and the cylinder-retaining strap in-between two or more cylinders in order to conform the cylinder-retaining strap more closely to the cylinders.

The pull-down strap may comprise a pull-down buckle secured to the strap in a slidable manner. The pull-down buckle may be separate to the buckle to which the second end of the strap is secured.

The cylinder-retaining strap may be configurable in: an expanded configuration having a first effective length for securing a first number of cylinders; and a contracted configuration in which the adjustable strap loop is secured to the third fixing point such that the strap forms a second effective length shorter than the first effective length for securing a second number of cylinders less than the first number of cylinders.

In the contracted configuration, a portion of the adjustable strap loop may overlay the cylinder-retaining strap. In particular, the adjustable strap loop may overlay a portion of the strap between the first fixing point and the buckle. The adjustable strap loop may overlay the cylinder-retaining strap between the first fixing point and the buckle when the strap loop is secured to the third fixing point.

According to a second aspect, there is provided a breathing apparatus comprising a support frame according to the first aspect.

According to a third aspect, there is provided a method of adjusting a cylinder configuration of a breathing apparatus comprising:

providing a support frame comprising a cylinder cradle for supporting a compressed gas cylinder on the support frame, and a cylinder-retaining strap having a first end and a second end;

securing the first end to the support frame at a first fixing point and adjustably securing the second end to the cylinder-retaining strap between the first and second ends so as to form an adjustable strap loop formed of a portion of the cylinder-retaining strap, and securing the adjustable strap loop to a second fixing point so as to form an effective strap length between the first and second fixing points; and adjusting the effective strap length by:

adjusting a position of the second end along the cylinder-retaining strap to thereby adjust a size of the adjustable strap loop; and releasably securing the adjustable strap loop to a releasable third fixing point.

The method may further comprise: configuring the cylinder-retaining strap in an expanded configuration, in which the strap has a first effective length for securing a first number of cylinders, and in which the adjustable strap loop is not secured at the third fixing point; and configuring the cylinder-retaining strap in a contracted configuration in which the adjustable strap loop is secured to the third fixing point such that the strap forms a second effective length shorter than the first effective length for securing a second number of cylinders less than the first number of cylinders.

To avoid unnecessary duplication of effort and repetition of text in the specification, certain features are described in relation to only one or several aspects of the invention. However, it is to be understood that, where it is technically possible, features described in relation to any aspect of the invention may also be used with any other aspect or embodiment of the invention.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE INVENTION

Figure 1:
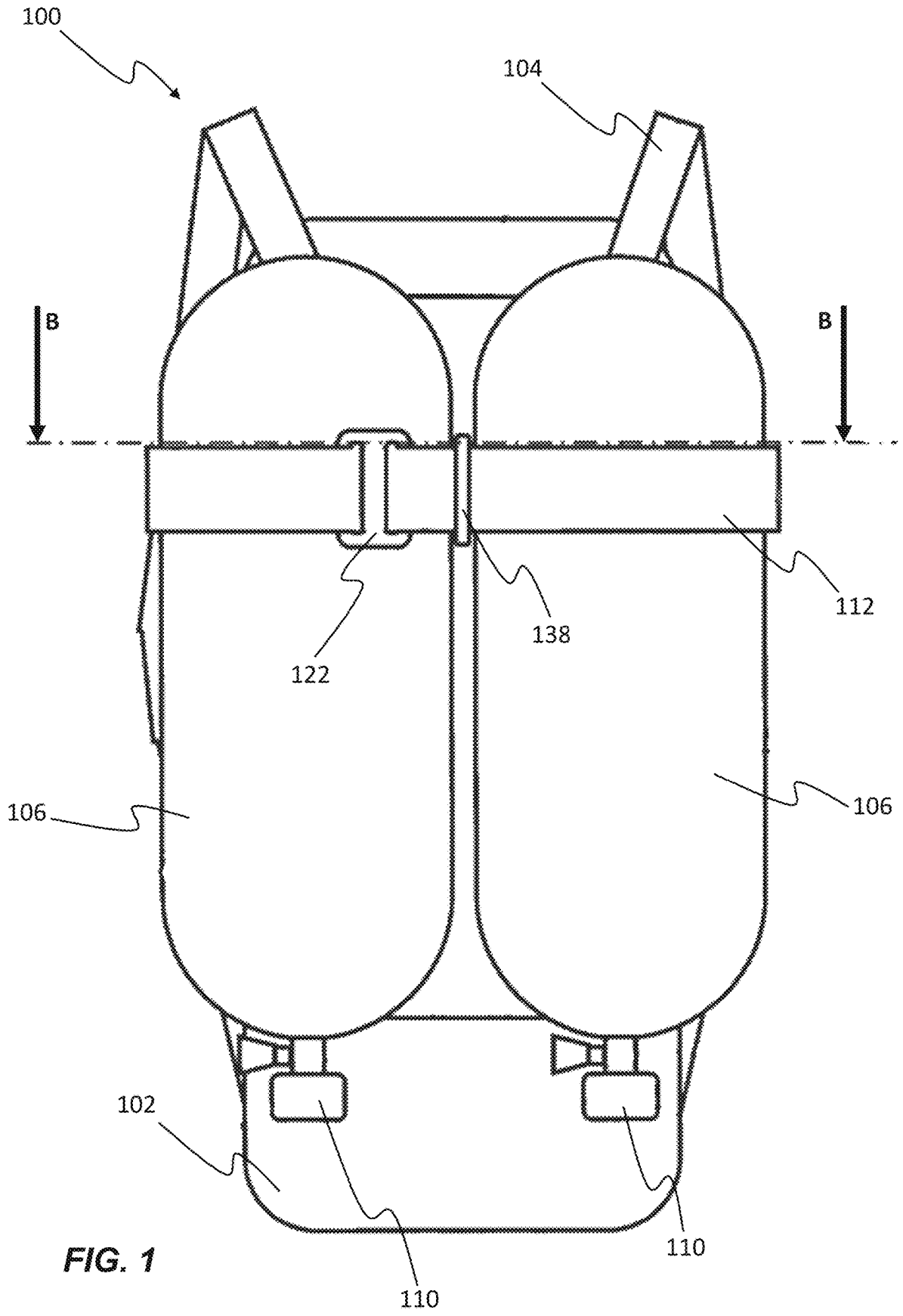
FIG. 1 is a rear view of an exemplary breathing apparatus comprising a cylinder retaining apparatus in an expanded configuration.
Figure 2:
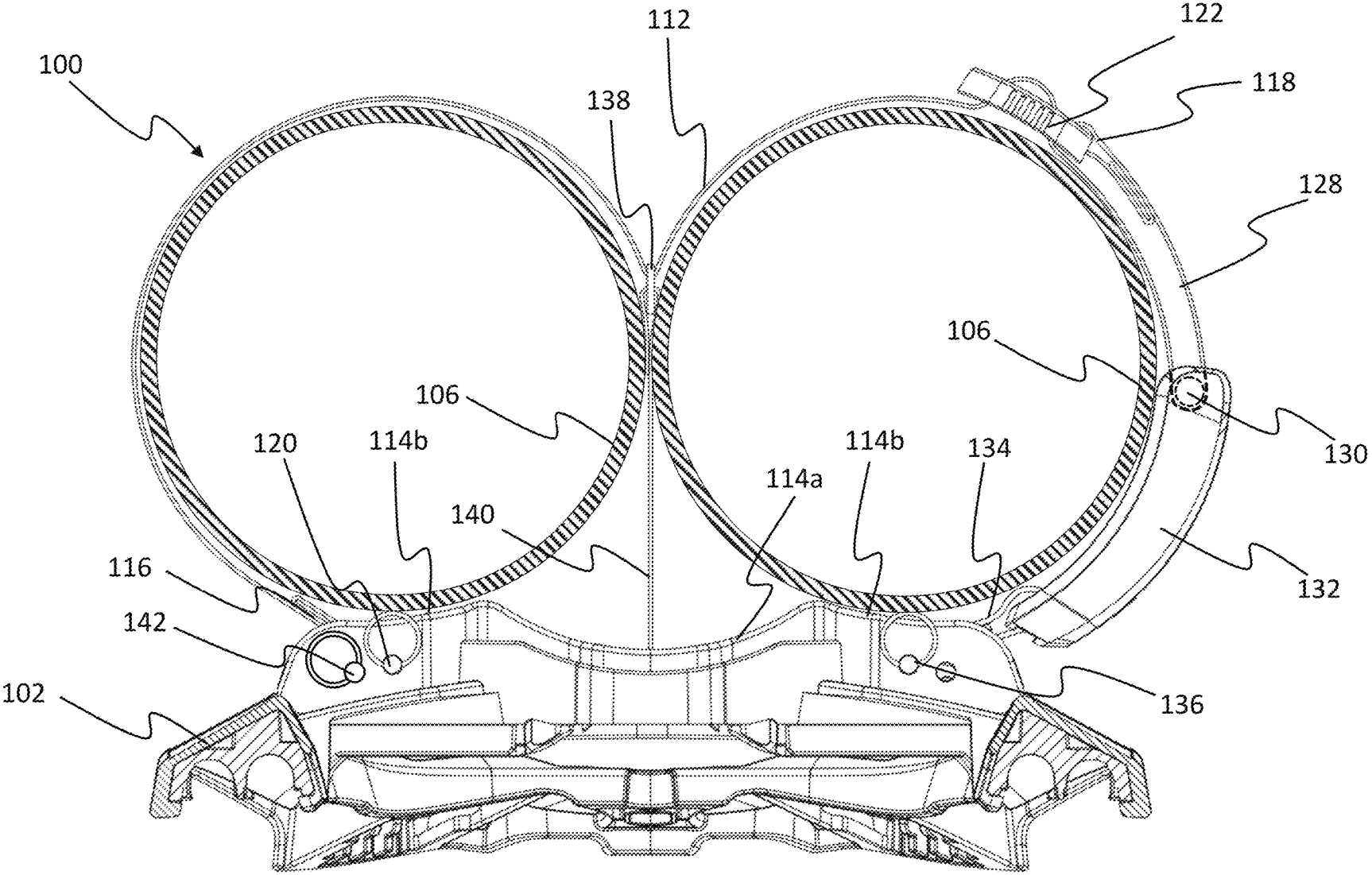
FIG. 2 is a sectional view of the breathing apparatus of FIG. 1.

FIGS. 1 and 2 illustrate a breathing apparatus 100 is shown. The breathing apparatus 100 comprises a support frame 102, which is wearable on a user's back using shoulder straps 104. The breathing apparatus 100 in this case is a self-contained breathing apparatus or "SCBA", but it should be understood that other breathing apparatus types, such as closed circuit breathing apparatus (CCBA), could apply the principles of this disclosure.

FIG. 1 shows a rear view of the breathing apparatus 100. The support frame 102 supports two breathing gas cylinders 106 (each of which will be referred to simply as a "cylinder" for brevity in this description). The cylinders 106 each comprise a respective valve 110, which can be secured to the support frame 102 at the lower end thereof, for example by connection to a pressure reducer valve of the breathing apparatus 100 (not shown).

The cylinders 106 extend longitudinally along the support frame 102 in parallel and in a side-by-side fashion. A cylinder-retaining strap 112 is provided proximate an upper end of the support frame 102 to secure an upper end of each of the cylinders 106. In this example, the cylinder-retaining strap 112 engages the cylinder 106 proximate an upper end of each cylinder 106 but in other examples it may be arranged to retain the cylinders 106 at another longitudinal location.

It is important to appreciate that, in FIGS. 1 and 2, the breathing apparatus 100, and more specifically, the cylinder-retaining strap 112 is configured in an expanded configuration for retaining two cylinders. As will be evident from this description as a whole, the cylinder-retaining strap 112 can also be configured in at least one other configuration, a contracted configuration, to hold one cylinder, which will be described in more detail below with reference to FIGS. 3 and 4. It should be understood that the principles of the present disclosure could be applied to construct a cylinder retaining apparatus which could retain different numbers of cylinders in its respective expanded and contracted configurations than the exemplary embodiments described here, for example three cylinders expanded and two or one contracted.

In FIG. 2, the structure of the breathing apparatus 100 can be observed in more detail. FIG. 2 shows a sectional view of the support frame 102 and cylinders 106 along the line BB in FIG. 1, viewed longitudinally along the breathing apparatus 100 from an upper end thereof. The support frame 102 comprises a cylinder cradle 114 which has a single central concave profile **114*a* to receive the convex shell of a single cylinder in the contracted configuration, and dual concave profiles 114*b* laterally spaced apart for receiving respective twin cylinders 106 in this expanded configuration. The profiles 114*b* serve to locate the cylinders 106 in the correct position on the support frame 102**.

The cylinder-retaining strap 112 has a first end 116 and a second end 118. The strap 112 is formed of a flexible flat webbing, although other material and constructions can be used.

Figure 4:
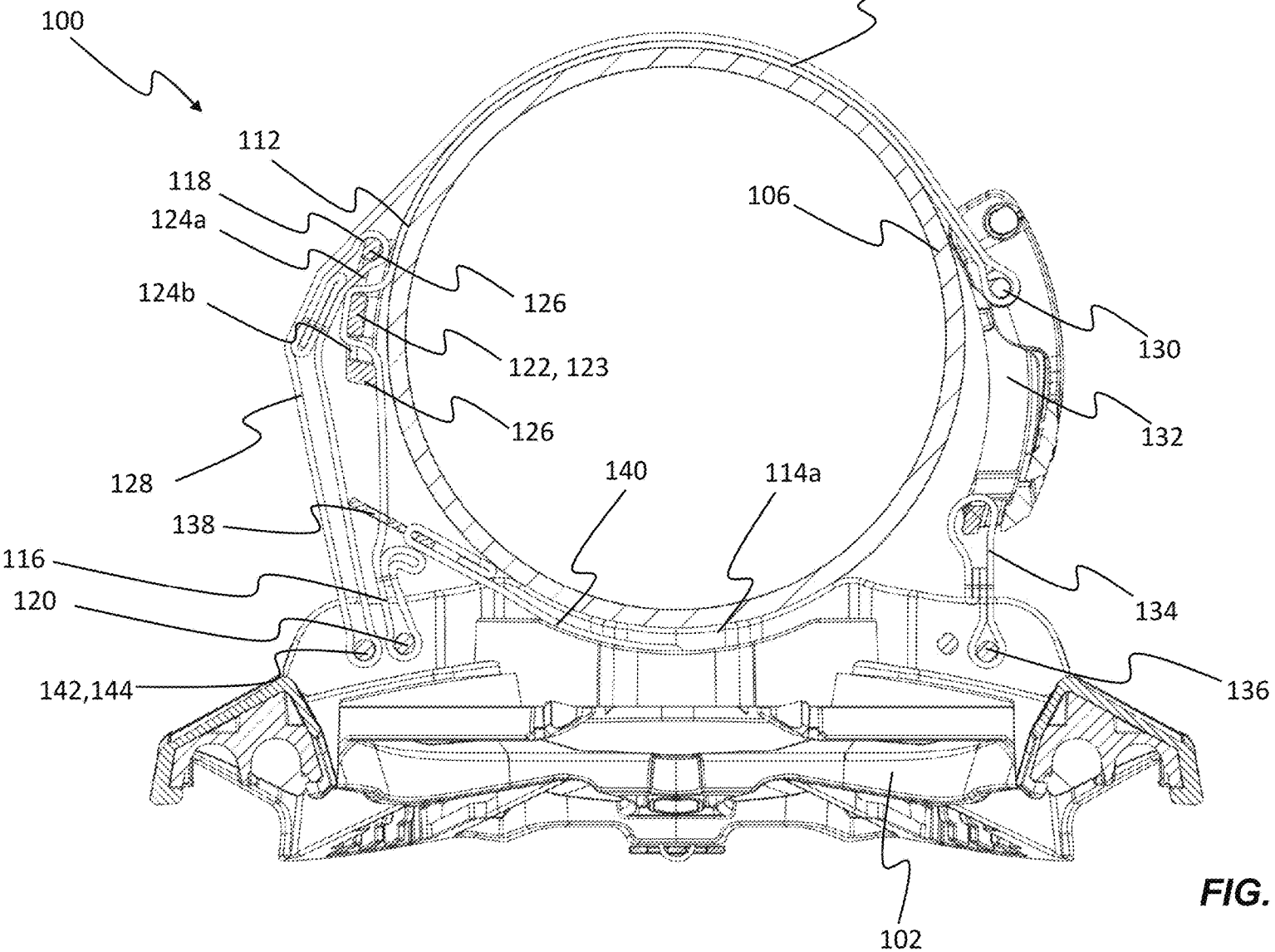
FIG. 4 is a sectional view of the breathing apparatus of FIG. 3.

The first end 116 of the strap is secured to the support frame at a first fixing point 120 provided on a first lateral side of the cylinder cradle 114 (see also FIG. 4). In this example, the first end of the strap 112 is stitched back on itself to form a securing loop, which is secured around a fixing pin that forms the first fixing point 120. In some examples, the first fixing point may be releasable.

Referring also to FIG. 4, a slidable buckle 122 is provided on the strap 112. The slidable buckle 122 comprises a central bridge 123, and two outer bridges 126 which have first and second slots **124*a* and 124*b* formed therebetween. The strap 112 extends through the first slot 124*a* from an inner to outer side of the buckle 122, over the central bridge 123, and then back through the other slot 124*b* from the outer to the inner side of the buckle 122. When the strap 112 is in tension, the buckle 122 is secured in position on the strap 112 by friction between the strap and the bridges. When the strap 112 is slack, the position of the buckle 122 along the strap 112 can be easily adjusted by sliding the buckle 122 along the strap 112**.

In this example, the second end of the strap 112 is stitched back on itself to form another securing loop, which is secured around one of the outer bridges 126. In this way, the second end of the strap 112 is secured back to the strap 112 itself at an intermediate point on the strap 112 in an adjustable manner. Intermediate position in this context should not be understood as implying any particular single position (such as an exact mid-point) and should instead be understood that the connection is made somewhere along the strap between the first and second ends.

As the strap 112 is secured back to itself, the strap 112 forms an adjustable strap loop 128 which is formed of a portion of the cylinder-retaining strap 112. By moving the slidable buckle 122 along the strap, the size of the adjustable strap loop 128 can be adjusted. The closer the buckle 122 is moved to the first fixing point 120, the larger the strap loop 128 will become (i.e., more of the strap 112 will form the strap loop 128).

The support frame 102 also comprises a second fixing point 130 to which the strap 112, and more specifically, the adjustable strap loop 128 is secured. In this example, the second fixing point 130 is a bridge pin of a tensioning buckle 132, which itself is attached to a secondary strap 134 that is in turn secured to a further fixing point 136 on the support frame. The tensioning buckle 132 is a cam-type tensioner. In other examples, the second fixing point 130 may be provided directly on the support frame 102 in the same manner as the first fixing point 120, or in another way entirely. Generally, it should be understood that the second fixing point may be spaced apart from the first fixing point in a lateral direction, or on substantially opposing sides of the cylinder cradle, such that the strap 112 can extend around the cylinder or cylinders 106 and secure it or them to the support frame 102.

The adjustable strap loop 128 extends around the second fixing point 130 (in this example the bridge pin of the tensioning buckle 132) such that the strap 112 is also secured to the second fixing point 130. In this way, it will be understood that the strap forms an effective strap length between the first and second fixing points.

Additionally, the strap apparatus comprises a pull-down buckle 138 which is secured to a distal end of a pull-down strap 140, as shown in detail in FIG. 2. The other, proximal end of the pull-down strap 140 is secured to the support frame 102 in between the cylinders 106, which in this twin cylinder example is a lateral midpoint of the cylinder cradle 114. The pull-down strap 140 is shorter in length than the diameter of the cylinders 106 and the strap 112 extends through a slot in the pull-down buckle 138, such that the strap 112 is pulled-down towards the cylinder cradle 114 between the cylinders 106 to provide additional contact of the strap 112 against the cylinders 106. In some other examples, a pull-down buckle and pull-down strap may not be provided, and the strap 112 may simply extend directly across the gap between the cylinders 106.

The effective length of the strap 112 extends around both cylinders 106 between the first and second fixing points 120, 130. As can be observed in FIG. 2, the part of the strap 112 which forms the adjustable strap loop 128 is essentially a folded portion of the strap 112 which is fed around the second fixing point 130. The adjustable strap loop 128 overlays itself such that it is essentially 'double stacked' above the cylinder surface. There is also a portion of the strap 112 between the first fixing point 120 and the buckle 122 which does not form part of the adjustable strap loop 128.

The cylinder-retaining strap 112 is therefore configured in this expanded configuration to extend around the cylinders 106. When the strap 112 is tightened or put into tension, for example using the tensioning buckle 132, or by another tensioning means, the cylinders 106 are urged against the cylinder cradle 114 and therefore secured to the support frame 102.

The breathing apparatus 100 may be used with cylinders of different diameters, and so it will be appreciated that cylinders 106 of different diameters can be accommodated in the expanded configuration by finely adjusting the effective length of the strap 112. This can be achieved by adjusting the position of the second end 118 of the strap 112 (i.e., the buckle 122) can be moved along the strap to adjust the effective strap length. Moving the buckle 122 towards the first end 116 will decrease the effective length, while moving the buckle 122 away from the first end will increase the effective length. This procedure can also be used to apply tension to the strap 112.

However, when it is required to change the breathing apparatus from a dual-cylinder (i.e., expanded) configuration to a single-cylinder (i.e., contracted) configuration, the adjustment available by moving the buckle 122 alone may not be sufficient and a more substantial adjustment of the cylinder-retaining strap 112 may be necessary.

Figure 3:
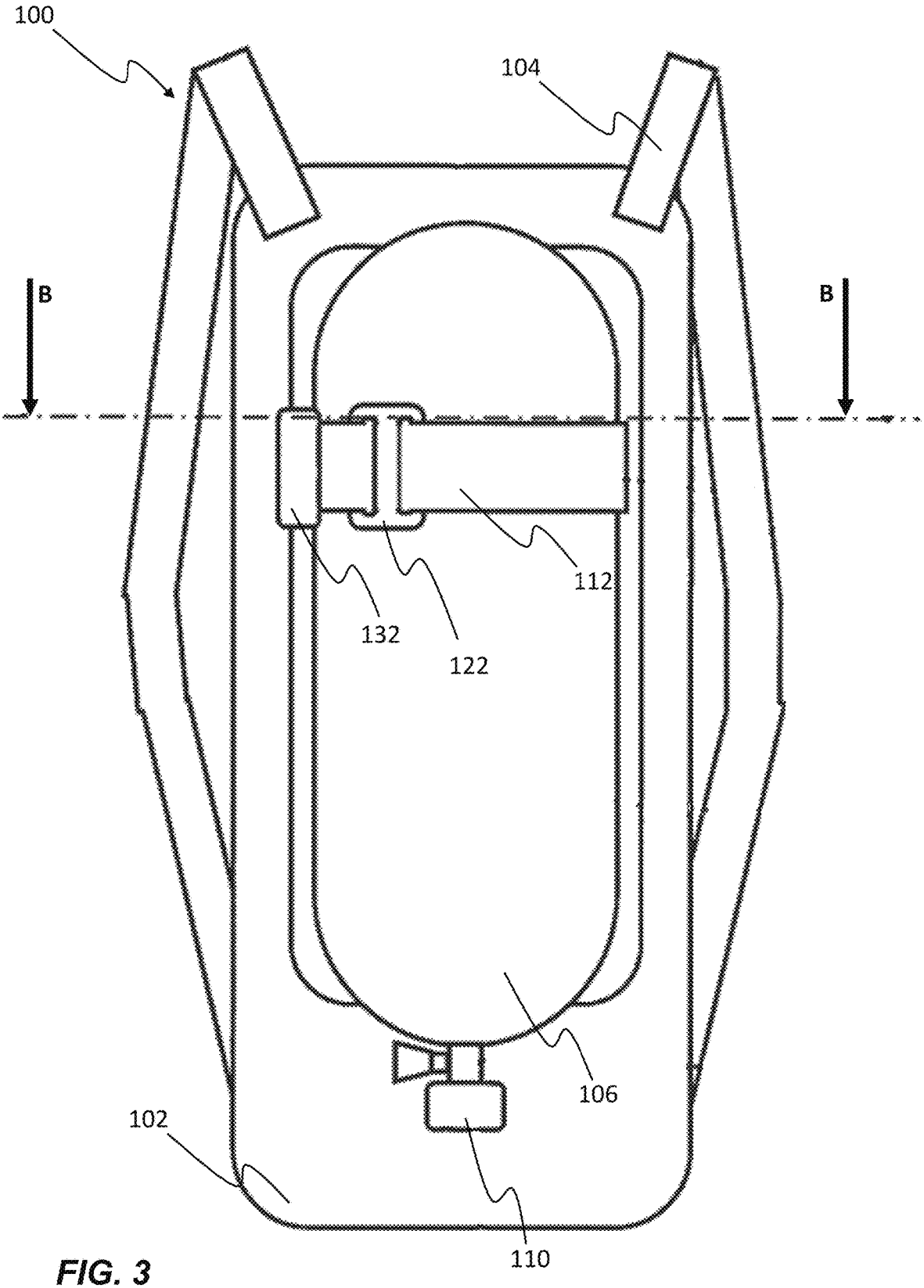
FIG. 3 is a rear view of an exemplary breathing apparatus comprising a cylinder retaining apparatus in a contracted configuration.

Turning now to FIGS. 3 and 4, the breathing apparatus 100, and more specifically, the cylinder-retaining strap 112 is configured in a contracted configuration for securing for securing fewer cylinders than the expanded configuration, in this example a single cylinder 106. FIG. 3 shows the breathing apparatus 100 in a rear view and FIG. 4 shows a sectional view along the line BB in FIG. 1, viewed longitudinally along the breathing apparatus 100 from an upper end thereof.

In the contracted configuration of FIGS. 3 and 4, the adjustable strap loop 128 has been significantly increased in size by sliding the buckle 122 along the strap 112 towards the first end 116. In addition, the adjustable strap loop 128 has been secured to a third fixing point 142. As can be observed in FIG. 4, a third fixing point 142 is provided on the support frame 102. In this example, the third fixing point 142 is formed by a removable pin 144. The pin 144 is retractable such that it can be retracted to attach and detach the strap loop 128 when adjusting between the expanded and contracted configurations. In other examples, the third fixing point could be any releasable fixing for securing the adjustable strap loop. For example, the third fixing point could alternatively be provided by an open or cut-away slot, or a clamp.

In this example, the third fixing point 142 is provided proximate the first fixing point 120 and, in particular, laterally outside the first fixing point 120. The third fixing point is also arranged on the same side of the cylinder cradle to the first fixing point and further from the cylinder cradle than the first fixing point. The third fixing point 142 could alternatively be provided in other locations than that illustrated in order to take up slack in the strap loop 128. More than one additional fixing point could be provided to enable a number of contracted/expanded configurations for securing different numbers of cylinders.

In the contracted configuration of this example, where only one cylinder 106 is retained, the pull-down strap 140 is not required, so it can be stowed flat against the support frame 102 by moving the pull-down buckle 138 along the cylinder-retaining strap 112 to a stowed position against the support frame 102 and adjacent the first and third fixing points 120,142.

Overall, it should be understood that a significant portion of the strap 112 which, in the expanded configuration, would have accommodated the additional second cylinder, is accommodated in the contracted configuration in the adjustable strap loop 128. As the adjustable strap loop 128 is much larger in the contracted configuration than the expanded configuration, it is necessary to secure this excess strap material by securing the strap loop 128 around both the second and third fixing points 130, 14. This configuration conveniently tensions the adjustable strap loop 128 and secures the excess strap material safely flat against the breathing apparatus 100.

For any given cylinder size or configuration, any unrequired or slack portion of the strap can be taken up un the adjustable strap loop by adjusting the position of the second end relative to the strap. Further, the slack in the adjustable strap loop can then be secured by additionally securing the adjustable strap loop to the third fixing point. In this contracted configuration, the adjustable strap loop is therefore connected to both the second and third fixing points. In this contracted configuration, it will be apparent that a portion of the adjustable strap loop 128 may overlay the cylinder-retaining strap 112 between the first fixing point 120 and the buckle 122.

The invention provides a greater range of adjustment than prior art systems by allowing a significant proportion of a long multiple-cylinder strap to be taken up using the releasable third fixing point. Accordingly, a strap which can accommodate multiple cylinders can be adjusted using the principles of the present disclosure to retain fewer cylinders by taking up the excess in a secondary strap loop, which can be conveniently secured to an additional fixing point. Further, the configuration of the adjustable strap may be particularly easy to adjust and simple in construction, which may enable rapid adjustment and longer life.

Owing to the design of the adjustable strap loop, it can be configured to be tightly secured overlaying the rest of the strap, so as to minimize the profile of the breathing apparatus and avoid loose strapping which would present a snagging hazard.

It will be appreciated by a skilled person that although the invention has been described by way of example, with reference to exemplary examples, it is not limited to the disclosed examples and that alternative examples could be constructed without departing from the scope of the invention as defined by the appended claims.

The invention claimed is:

1. A support frame for a breathing apparatus comprising:

a cylinder cradle for supporting a compressed gas cylinder on the support frame;

a cylinder-retaining strap having a first end secured to the support frame at a first fixing point and a second end adjustably secured to the cylinder-retaining strap between the first and second ends so as to form an adjustable strap loop formed of a portion of the cylinder-retaining strap, wherein the adjustable strap loop is secured to a second fixing point so as to form an effective strap length between the first and second fixing points; and a releasable third fixing point;

wherein the effective strap length is adjustable by:

adjusting a position of the second end along the strap to thereby adjust a size of the adjustable strap loop; and releasably securing the adjustable strap loop to the third fixing point.

2. A support frame for a breathing apparatus as claimed in claim 1, wherein the second end of the strap is secured to a slidable buckle on the strap.

3. A support frame for a breathing apparatus as claimed in claim 1, wherein the cylinder cradle is configured to support one or more cylinders extending longitudinally on the support frame, and the first and second fixing points are arranged on opposing lateral sides of the cylinder cradle.

4. A support frame for a breathing apparatus as claimed in claim 3, wherein the third fixing point is arranged laterally outside the first fixing point.

5. A support frame for a breathing apparatus as claimed in claim 1, wherein the second fixing point is provided on a tensioning buckle secured to the support frame by a secondary strap.

6. A support frame for a breathing apparatus as claimed in claim 1, further comprising a pull-down strap.

7. A support frame for a breathing apparatus as claimed in claim 1, wherein the cylinder-retaining strap is configurable in:

i) an expanded configuration having a first effective length for securing a first number of cylinders; and ii) a contracted configuration in which the adjustable strap loop is secured to the third fixing point such that the strap forms a second effective length shorter than the first effective length for securing a second number of cylinders less than the first number of cylinders.

8. A support frame for a breathing apparatus as claimed in claim 7, wherein, in the contracted configuration, a portion of the adjustable strap loop overlays the cylinder-retaining strap.

9. A breathing apparatus comprising a support frame as recited in claim 1.

10. A method of adjusting a cylinder configuration of a breathing apparatus comprising:

providing a support frame comprising a cylinder cradle for supporting a compressed gas cylinder on the support frame and a cylinder-retaining strap having a first end and a second end;

securing the first end to the support frame at a first fixing point and adjustably securing the second end to the cylinder-retaining strap between the first and second ends so as to form an adjustable strap loop formed of a portion of the cylinder-retaining strap, and securing the adjustable strap loop to a second fixing point so as to form an effective strap length between the first and second fixing points; and adjusting the effective strap length by:

adjusting a position of the second end along the cylinder-retaining strap to thereby adjust a size of the adjustable strap loop; and releasably securing the adjustable strap loop to a releasable third fixing point.

11. A method of adjusting a cylinder configuration of a breathing apparatus as claimed in claim 10, further comprising:

configuring the cylinder-retaining strap in an expanded configuration, in which the strap has a first effective length for securing a first number of cylinders, and in which the adjustable strap loop is not secured at the third fixing point; and configuring the cylinder-retaining strap in a contracted configuration in which the adjustable strap loop is secured to the third fixing point such that the strap forms a second effective length shorter than the first effective length for securing a second number of cylinders less than the first number of cylinders.

* * * * *